United States Patent [19]

Swinney

[11] 4,325,503

[45] Apr. 20, 1982

[54] PAINTER'S BELT-ON BRUSH AND BUCKET HOLDER AND CARRIER

[76] Inventor: Glen E. Swinney, Rte. 1, Box 234-A, Axton, Va. 24054

[21] Appl. No.: 225,971

[22] Filed: Jan. 21, 1981

[51] Int. Cl.[3] ..... A46B 17/00

[52] U.S. Cl. ..... 224/148; 224/268; 224/250

[58] Field of Search ..... 224/250, 197, 226, 242, 224/253, 255, 268, 270, 904, 907, 148

[56] References Cited

U.S. PATENT DOCUMENTS

| | | | |
|---|---|---|---|
| 1,109,161 | 9/1914 | Chindgren | 224/148 |
| 2,717,109 | 9/1955 | Walsh | 224/148 |
| 2,985,349 | 5/1961 | McGuire | 224/268 |
| 2,987,231 | 6/1961 | Lewis | 224/268 X |
| 2,995,281 | 8/1961 | Dixon | 224/148 |
| 3,285,482 | 11/1966 | Bedsaul, Sr. | 224/268 |
| 3,380,635 | 4/1968 | Stone et al. | 224/197 X |
| 3,401,857 | 9/1968 | Wilson et al. | 224/253 X |
| 3,493,152 | 2/1970 | Ort | 224/268 X |
| 3,876,125 | 4/1975 | Emmert | 224/148 |

*Primary Examiner*—Steven M. Pollard

[57] ABSTRACT

A practical article for carrying a paint bucket and paintbrush on the person of a painter so as to leave his hands free, having a lightweight rack portion to which the bucket and brush can be secured, a member supportable by a belt, and connecting means between the rack and member providing relative movement between them so that the weight of the bucket and rack maintains the bucket in an upright position as the painter moves about his work while damping its tendency to oscillate too freely, enabling increased productivity of the painter while making his work less tiring.

5 Claims, 5 Drawing Figures

PAINTER'S BELT-ON BRUSH AND BUCKET HOLDER AND CARRIER

This invention provides a practical and effective apparatus for attaching a paint can to the body of a painter so as to hold it in a convenient and readily adjustable position for use as he moves about and at the same time leaves his hands free for activities associated with his work, such as moving or climbing ladders, or scraping away old paint. It enables increased productivity and at the same time makes the work less tiring by eliminating bending, stooping, and reaching for and lifting the paint can.

The invention essentially comprises a combination of three parts. First, is a light weight rack to which a paint can of standard construction and convenient size may be securely attached. Conveniently, this part may also be provided with a spring clip for holding a paintbrush above the paint in the can. A second part of the invention is a member supportable by a belt around the waist of the user. The third part of the invention is a means for linking the rack to said member in a novel manner, more fully described hereinafter, to enable the weight of the can and rack and the paint in the can to maintain the can in an upright position as the painter moves about the job, and to enable the painter to adjust the position of the can to some extent without the need to hitch the support means along the belt. At the same time, the movement of the linking means is effectively damped by frictional forces so as to substantially prevent pendulum-like oscillation of the can under the influence of the painter's movements, and similarly the frictional forces between elements of the linking means enable the position of the can to remain stable at the position selected by the painter.

The invention is intended for use with conventional paint containers of convenient size. Paint is commonly supplied to consumers in one gallon cans of substantially uniform proportions and design. Such cans are cylindrical in shape, about six and one-half inches in diameter, and the cylindrical side is about seven and one-half inches high. They are normally provided with a wire bail or handle for lifting and carrying. Where the circular bottom of the can is joined to the cylindrical side, there is a downwardly projecting circular rim of about one-eighth of an inch. Since such standard cans are readily available and of convenient size for use with the invention, the best mode contemplated by the applicant for making and using the invention will be described with respect thereto. It will be understood, however, that the invention is applicable to the carrying of paint cans of other convenient sizes.

Considering now the drawings.

Figure 1:
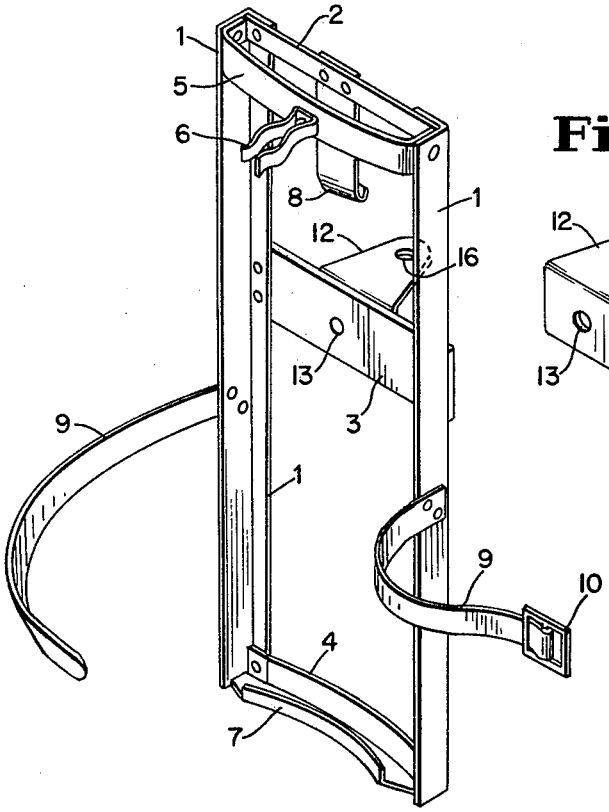
FIG. 1 is a perspective view of the rack portion of the invention.

As shown in FIG. 1, the rack portion comprises upright members 1, 1, connected rigidly and in parallel relationships by cross pieces 2, 3, and 4. Another cross member 5 provides added strength and rigidity and is also shown having attached thereto spring clip means 6 for holding a paintbrush. For lightness and strength, the upright members are shown as being structural members of angular cross section.

The lowermost member 4 of the rack portion is provided with an upwardly directed detent, shown as a curved lip 7 adapted to fit under and retain the downwardly directed rim at the base of a conventional paint can. A hook-like member 8 is attached as shown to the uppermost cross member 2 so that the bail of such paint can can be slipped over the top of the rack and retained by said hook-like member.

Strap means 9 is attached to the parallel upright members and is adapted to be fastened around a paint can which is placed on and retained by lip 7, to hold it tightly against the rack by conventional fastening means such as buckle 10.

The intermediate cross piece 3 of the rack portion of the invention is provided with angular connecting member 12 pivotally mounted at 13 by means which permits rotation, such as a rivet. The angular connecting member is also pivotally connected to a hinge member 14 of the belt-carried support, as at 16.

Figure 5:
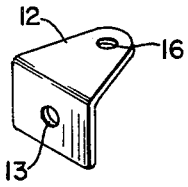
FIG. 5 is a perspective view of the angular connecting member 12 which movably connects the rack of FIG. 1 to the belt-carried subassembly of FIG. 2.

Considering FIG. 2, the frame 15 only of the supporting portion or member of this invention is shown, without its preferred covering of leather or similar tough, somewhat pliable leather-like material which is so applied as to provide a passage along the top through which may be passed a belt which may be fastened about the waist of the user as will be made clearer in FIG. 4. At the lower portion of the frame, hinged member 14 is provided which is adapted to be connected pivotally, as by a rivet at position 16, to the correspondingly numbered angular linking member 12 (FIGS. 1, 5) which in turn is adapted to be pivotally connected to cross member 3 of the rack (FIG. 1) at position 13, as for example by rivet means (FIG. 3).

Figure 2:
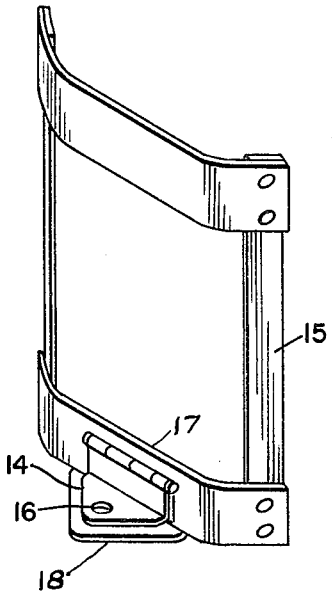
FIG. 2 is a perspective view showing the frame only of the belt-carried part of the invention, without its leather covering by which in a preferred embodiment it would be suspended on a belt about the waist of the user as will hereinafter be seen in FIG. 4.

The lowermost horizontal member 17 of the frame of FIG. 2 is also provided with a horizontally extending lug or member 18 which extends beneath the hinged member as shown and serves as a detent to prevent the rack of FIG. 1 from striking too hard against the side of the wearer and to serve both to stop oscillation and provide added support.

Figure 3:
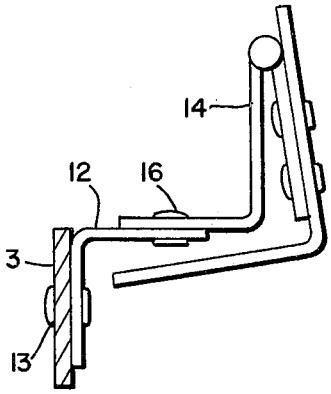
FIG. 3 is a side elevation showing the means by which the rack portion of FIG. 1 is connected to the belt-carried member of FIG. 2 in a manner to permit the rack to be rotationally movable about three different axes at right angles to one another.

As shown in FIG. 3, which is to a somewhat larger scale than the other figures, hinge member 14 permits the rack assembly, cross member 3 of which is shown in section, to swing away from the wearer when he leans in the direction of the paint can and its support rack, thus preventing tilting of the can. The pivotal means at position 13, by which member 12 is connected to the rack, permits the rack and can to remain substantially upright under the influence of the weight of the rack, the can, and the paint therein since the center of gravity of this entire subassembly is substantially below the pivot position 13. At the same time, this pivot means provides sufficient friction, by reason of direct rubbing contact between members 3 and 12, to effectively damp any tendency to oscillate like a pendulum under the influence of the user's movements.

It will also be seen from FIG. 3 that the pivotal connection, as by a rivet at 16, between members 12 and 14 permits relative movement about a vertical axis so that the user can adjust the position of the can to suit his convenience and that at the same time friction between members 12 and 14 effectively inhibits undesired movement of the can about this vertical axis.

Figure 4:
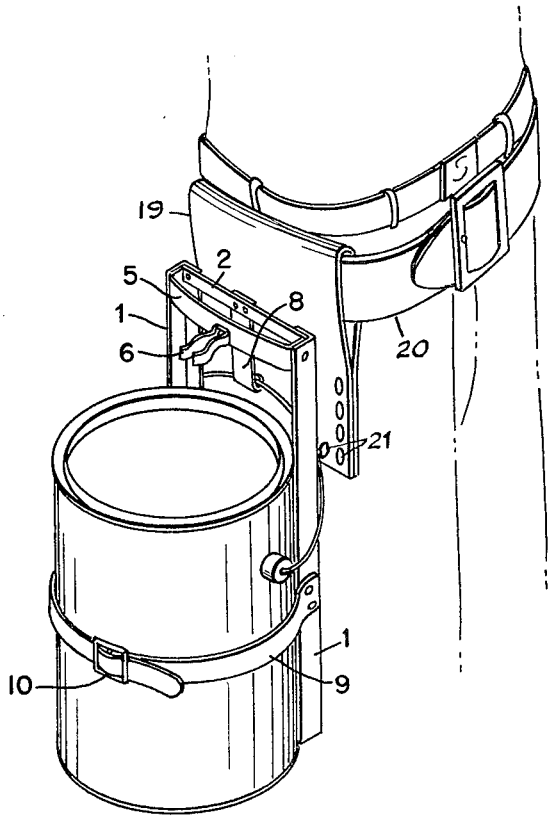
FIG. 4 is a perspective view illustrating the assembled apparatus and the manner of using the invention to carry a can of paint for use at the side of the painter.

FIG. 4 shows the appearance of the invention in use. For clarity in showing how the bail of a paint can is retained in hook-like member 8 so as to provide added security against dropping the can in the event strap means 9 fails for some reason, a brush is not shown in position in clip 6. It will be seen that the frame of FIG. 2 is covered by a layer 19 of leather or similar material, which is folded over the top of the frame in a manner to provide a passage along the top for belt 20, and which covering is securely fastened in a manner to support the frame as by rivets 21.

The invention may be used to attach and support a paint can on either side of the workman depending on whether he is left- or right-handed. It preferably is not used directly in front as it would interfere with leg movement. As noted above, it is contemplated that it will be used with standard paint cans such as those in which paint is normally purchased from a supplier. Of course, paint could be purchased in bulk in larger containers than can be conveniently carried on the job, and transferred to standard cans of convenient size.

It will further be observed that it is sometimes regarded as prudent by painters, when starting to use a new can of paint, to pour out and set aside a portion of the paint until some of that remaining in the can has been used. The same prudent procedure may be followed when using this invention, but experience has shown that there is no greater tendency for accidental spillage with this invention than when painting in the old way.

What I claim is:

1. A holder for carrying a paint can on the person of the painter comprising (1) a rack directly attachable to said can for securely holding it, comprising: a pair of parallel upright elements, strap means for firmly attaching the can against said elements, support means at the lower part of said rack provided with an upwardly directed lip adapted to fit under and retain the circular rim at the bottom of the paint can, (2) a supporting member adapted to be carried by a belt and held thereby against the side of the painter, having thereon an outwardly extending member attached by hinge means for limited movement on a horizontal axis disposed paralled to the side of the painter, and (3) a connecting link pivotally connected to an upper portion of the rack for free frictionally inhibited rotational movement of the rack about a horizontal axis under the influence of gravity and also pivotally connected to said hinged element of said supporting member for adjustably positioning said can forwardly or rearwardly about a vertically disposed axis.

2. The article of claim 1 in which hook means is provided rearwardly on the rack member for retention of the wire bail of a paint can.

3. The article of claim 1 wherein said supporting member is provided with an outwardly extending portion beneath the outwardly extending portion of the hinged member limiting its downward movement and reinforcing it in the lowermost position.

4. The article of claim 1 in which the said supporting member is provided with a covering of tough material folded over the member and fastened thereto in a manner providing a channel along the top for passing a belt therethrough.

5. The article of claim 4 wherein said covering is of leather.

* * * * *